US009302479B2

(12) United States Patent
Fujii et al.

(10) Patent No.: US 9,302,479 B2
(45) Date of Patent: Apr. 5, 2016

(54) LIQUID EJECTION HEAD SUBSTRATE, LIQUID EJECTION HEAD, AND RECORDING APPARATUS

(71) Applicant: CANON KABUSHIKI KAISHA, Tokyo (JP)

(72) Inventors: Yasuo Fujii, Hiratsuka (JP); Tatsuhito Goden, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/468,088

(22) Filed: Aug. 25, 2014

(65) Prior Publication Data

US 2015/0062252 A1 Mar. 5, 2015

(30) Foreign Application Priority Data

Aug. 27, 2013 (JP) ..... 2013-175726

(51) Int. Cl.
*B41J 2/05* (2006.01)
*B41J 2/14* (2006.01)
*B41J 2/045* (2006.01)

(52) U.S. Cl.
CPC ..... *B41J 2/14072* (2013.01); *B41J 2/04528* (2013.01); *B41J 2/04563* (2013.01); *B41J 2/04565* (2013.01)

(58) Field of Classification Search
CPC ..... B41J 2/14072; B41J 2/04528; B41J 2/04563; B41J 2/04565
USPC ..... 347/17, 19, 14, 58
See application file for complete search history.

(56) References Cited

U.S. PATENT DOCUMENTS

2010/0053278 A1* 3/2010 Omata et al. ..... 347/63

FOREIGN PATENT DOCUMENTS

JP 2010-076441 A 4/2010

* cited by examiner

*Primary Examiner* — Henok Legesse
(74) *Attorney, Agent, or Firm* — Canon U.S.A., Inc. IP Division

(57) ABSTRACT

A liquid ejection head substrate according to an exemplary embodiment of the present invention includes a plurality of ejection heaters arranged in a first region, a drive circuit that is arranged in the first region and configured to supply electric energy to the plurality of ejection heaters, a signal supply circuit that is arranged in a second region and configured to supply an electric signal to the drive circuit, and a substrate heating heater including a first portion arranged in the first region and a second portion arranged in the second region, in which a resistance value per unit length along a direction of a current of the first portion is different from a resistance value per unit length along a direction of a current of the second portion.

30 Claims, 4 Drawing Sheets

LIQUID EJECTION HEAD SUBSTRATE, LIQUID EJECTION HEAD, AND RECORDING APPARATUS

BACKGROUND OF THE INVENTION

1. Field of the Invention

A technology disclosed in the present specification relates to a liquid ejection head substrate, a liquid ejection head, and a recording apparatus.

2. Description of the Related Art

A thermal type liquid ejection head is used in a recording apparatus that performs recording by ejecting a liquid such as ink towards a recording medium. A thermal type liquid ejection head disclosed in Japanese Patent Laid-Open No. 2010-076441 (hereinafter, will be referred to as Patent Document 1) includes a substrate on which an ejection heater is arranged, a conductive line for applying a current to the ejection heater, and a sub heater that is electrically isolated from the conductive line. Furthermore, Patent Document 1 discloses that the sub heater is constituted by a conductive member and also that a substrate is heated by applying a current to the conductive member. It is disclosed that, with such a configuration, generation of a temperature distribution in the substrate included in the liquid ejection head can be suppressed.

SUMMARY OF THE INVENTION

A liquid ejection head substrate of an embodiment according to an aspect of the present invention includes: a plurality of ejection heaters arranged in a first region; a drive circuit that is arranged in the first region and configured to supply electric energy to the plurality of ejection heaters; a signal supply circuit that is arranged in a second region and configured to supply an electric signal to the drive circuit; and a substrate heating heater including a first portion arranged in the first region and a second portion arranged in the second region, in which a resistance value per unit length along a direction of a current of the first portion is different from a resistance value per unit length along a direction of a current of the second portion.

A liquid ejection head substrate of the embodiment according to another aspect of the present invention includes: a plurality of ejection heaters; a drive circuit configured to supply electric energy to the plurality of ejection heaters; a signal supply circuit that includes a first circuit block arranged in a first region and a second circuit block arranged in a second region and configured to supply an electric signal to the drive circuit; and a substrate heating heater including a first portion arranged in the first region and a second portion arranged in the second region, in which a resistance value per unit length along a direction of a current of the first portion is different from a resistance value per unit length along a direction of a current of the second portion.

A liquid ejection head substrate of the embodiment according to still another aspect of the present invention includes: a plurality of ejection heaters; a drive circuit configured to supply electric energy to the plurality of ejection heaters; a signal supply circuit that includes a first circuit block arranged in a first region and a second circuit block arranged in a second region and configured to supply an electric signal to the drive circuit; and a substrate heating heater including a first portion arranged in the first region and a second portion arranged in the second region, in which a line length of the first portion is different from a line length of the second portion, and an area density of the first portion is different from an area density of the second portion.

Further features of the present invention will become apparent from the following description of exemplary embodiments with reference to the attached drawings.

DESCRIPTION OF THE EMBODIMENTS

Figure 1:
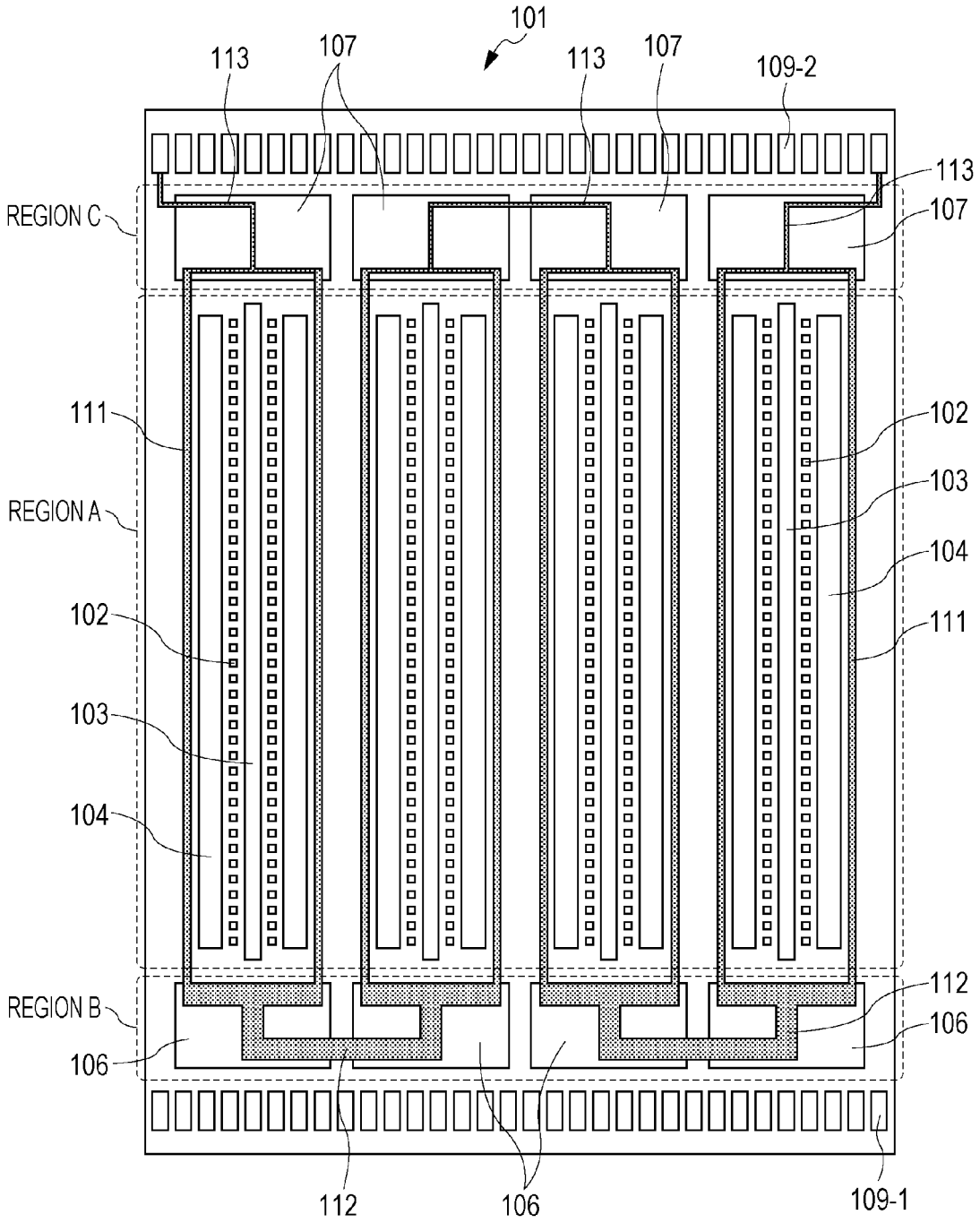
FIG. 1 schematically illustrates a planar structure of a liquid ejection head substrate.

According to some of exemplary embodiments of the present invention, it is possible to perform temperature control in accordance with a location in a liquid ejection head substrate.

In the liquid ejection head disclosed in Patent Document 1, conductive members of a sub heater are arranged so as to form a single current path across the entire substrate. The conductive members constituting the sub heater have a substantially uniform line width. When a current is applied to the above-described conductive members, it is possible to substantially evenly heat up the entire substrate.

However, in the sub heater described in Patent Document 1, it is difficult to locally heat up a part of the substrate or vary the heat generation quantity of the sub heater in accordance with a location in the substrate. For that reason, for example, in a case where the heat generation quantity at the time of operation differs depending on the location in the substrate or the like, the temperature distribution generated in the substrate may not be sufficiently suppressed. Alternatively, it is difficult to set temperatures in a plurality of portions of the substrate to have appropriate temperatures in accordance with the respective portions.

In view of the above-described problems, the inventors of the present invention disclose a technology with which it is possible to perform the temperature control in accordance with the location in the liquid ejection head substrate.

Exemplary Embodiments

An exemplary embodiment of the present invention relates to a liquid ejection head substrate provided with elements configured to eject a liquid such as ink. Another exemplary embodiment of the present invention relates to a liquid ejection head provided with a liquid ejection head substrate and an ink supply unit configured to supply recording ink to the liquid ejection head substrate. The liquid ejection head is, for example, a recording head of a recording apparatus. Still another exemplary embodiment of the present invention relates to a recording apparatus provided with a liquid ejection head and a drive unit configured to drive the liquid ejection head. The recording apparatus is, for example, a printer or a copier. Alternatively, the liquid ejection head according to the exemplary embodiment of the present invention can be applied to an apparatus or the like that is used for manufacturing a DNA chip, an organic transistor, a color filter, or the like.

A plurality of ejection heaters are arranged on the liquid ejection head substrate. A drive circuit is arranged on the liquid ejection head substrate so as to correspond to the plurality of ejection heaters. One drive circuit may be arranged for each of the ejection heaters. Alternatively, one drive circuit may be arranged so as to correspond to a group constituted by a plurality of ejection heaters. The drive circuit supplies electric energy to the plurality of ejection heaters. The drive circuit includes, for example, a transistor connected to the ejection heater and applies a current to the ejection heater via the transistor. The ejection heater generates heat when the current is applied to the ejection heater, and the liquid can be ejected. The drive circuit may include the transistor connected to the ejection heater, and a buffer or level shifter connected to the transistor.

A signal supply circuit configured to supply an electric signal to the drive circuit is arranged on the liquid ejection head substrate. The electric signal supplied by the signal supply circuit is, for example, a power supply voltage of the drive circuit or a control signal of the drive circuit. The control signal of the drive circuit may be generated on the basis of information supplied from the outside. The signal supply circuit may include a plurality of circuit blocks having different functions. For example, the signal supply circuit may include a signal processing circuit configured to process information supplied from the outside and a voltage generation circuit configured to generate, from a first power supply voltage supplied from the outside, a second power supply voltage that is different from the first power supply. The voltage generation circuit supplies the power supply voltage to the drive circuit.

As described above, a plurality of circuits such as the drive circuit configured to drive the ejection heaters and the signal supply circuit are mounted on the liquid ejection head substrate in addition to the ejection heaters. In these circuits, the heat generation quantities at the time of operations may vary from each other. Alternatively, temperatures suitable for the operations may vary from each other in some cases. For example, as the temperature is increased in an ejection heater, a liquid ejection characteristic is improved. For that reason, the ejection heater preferably operates at as high a temperature as possible. On the other hand, as the temperature is decreased in the signal supply circuit, an electric characteristic is further improved. However, in a case where the temperature of the signal supply circuit is too low, breaking or the like is likely to occur because of heat expansion of the material constituting the line. For that reason, the signal supply circuit preferably operates within a predetermined temperature range.

A substrate heating heater configured to preliminarily heat up the liquid ejection head substrate (hereinafter, will be referred to as sub heater) is provided to the liquid ejection head substrate. Since a current flows through the sub heater, the sub heater generates heat. The sub heater includes a first portion arranged in a first region and a second portion arranged in a second region. According to some embodiments, a resistance value per unit length along a current direction in the first portion and a resistance value per unit length along a current direction in the second portion are different from each other. According to some embodiments, a line length and an area density of the first portion are respectively different from a line length and an area density of the second portion.

With the above-described configuration, the heat generation quantity per unit area generated by the sub heater can be varied in the first region and the second region. For that reason, it is possible to perform temperature control in accordance with a location in the liquid ejection head substrate. For example, even in a case where a difference in the heat generation quantity at the time of operation exists between the first region and the second region, the temperature distribution generated in the liquid ejection head substrate can be reduced. Alternatively, it is possible to avoid generation of a temperature distribution in the liquid ejection head substrate. Alternatively, in order that the respective portions of the liquid ejection head substrate can operate at optimal temperatures, a temperature distribution in the liquid ejection head substrate can be increased.

According to some embodiments, the ejection heater and the drive circuit are arranged in the first region, and the signal supply circuit is arranged in the second region. According to some of the other embodiments, a first circuit block of the signal supply circuit, such as the voltage generation circuit, for example, is arranged in the first region, and a second circuit block of the signal supply circuit, such as the signal processing circuit, for example, is arranged in the second region.

For example, since the power consumption is increased as an operation frequency of the signal processing circuit is increased, the heat generation quantity of the signal processing circuit tends to be increased. For that reason, the substrate temperature tends to be higher in a region close to the signal processing circuit smaller than a region far from the signal processing circuit. Therefore, by setting the heat generation quantity per unit area of the sub heater in the second region where the signal processing circuit is arranged to be lower than the heat generation quantity per unit area of the sub heater in the first region, it is possible to reduce the temperature distribution generated in the substrate.

According to some of the other embodiments, the heat generation quantity of the ejection heater arranged in the first region may be higher than the heat generation quantity of the signal supply circuit arranged in the second region. In the above-described case, a size of a current applied to the first portion of the sub heater is set to be larger than a size of a current applied to the second portion of the sub heater. Accordingly, since the ejection heater operates at a still higher temperature, it is possible to improve the ejection characteristic. In addition, since the operation temperature of the signal supply circuit can also be increased, it is possible to improve the reliability of the liquid ejection head substrate while the electric characteristic of the signal supply circuit is maintained.

First Exemplary Embodiment

A first exemplary embodiment will be described. FIG. 1 schematically illustrates a planar structure of a liquid ejection head substrate 101. A liquid ejection head used as a recording head of a recording apparatus includes the liquid ejection head substrate 101 and an ejection orifice forming member (not illustrated) which is provided to the liquid ejection head substrate 101. A plurality of ejection orifices (not illustrated) for ejecting ink are provided in the ejection orifice forming member.

The liquid ejection head substrate 101 includes a region A, a region B, and a region C. Chain lines in FIG. 1 illustrate outer edges of the respective regions for the purpose of convenience. In FIG. 1, the region A, the region B, and the region C of the liquid ejection head substrate 101 are aligned along a direction in which a plurality of ejection heaters 102 are aligned in the respective heater columns, that is, along a long side of the liquid ejection head substrate 101. Instead, the region A, the region B, and the region C may be aligned along a direction intersecting with the direction in which the ejection heaters 102 are aligned, that is, along a short side of the liquid ejection head substrate 101.

The plurality of ejection heaters 102 are arranged in the region A of the liquid ejection head substrate 101. The plurality of ejection heaters 102 are arranged so as to form eight heater columns. The direction in which the plurality of ejection heaters 102 included in the respective heater columns are aligned is a direction along the long side of the liquid ejection head substrate 101. The eight heater columns are aligned in a direction along the short side of the liquid ejection head substrate 101. In FIG. 1, eight heater columns are arranged, but the number of columns may be appropriately changed depending on the type of ink. In the liquid ejection head, the plurality of ejection heaters 102 and the plurality of ejection orifices are provided so as to correspond to each other. Supply orifices 103 for supplying ink to the ejection heaters 102 are provided so as to penetrate through the liquid ejection head substrate 101. The plurality of supply orifices 103 are provided in a ratio such that one supply orifice 103 is provided for every two heater columns.

Heater drive circuits 104 are also arranged in the region A of the liquid ejection head substrate 101. The heater drive circuits 104 configured to drive the ejection heaters 102 are arranged so as to correspond to respective ones of the eight heater columns constituting the plurality of ejection heaters 102. Each heater drive circuit 104 is arranged in a region on an opposite side to a side where the corresponding column of the supply orifices 103 is provided with respect to the corresponding column of the ejection heaters 102.

The heater drive circuits 104 are configured to supply electric energy to the ejection heaters 102. Although not illustrated in FIG. 1, the heater drive circuits 104 according to the present exemplary embodiment each include a transistor connected to a corresponding ejection heater 102 and a buffer connected to the transistor. A current is applied to the ejection heaters 102 in accordance with a control signal supplied to the transistors via the buffers. Each heater drive circuit 104 may include a level shifter instead of the buffer.

An operation of ejecting the ink in the liquid ejection head substrate 101 according to the present exemplary embodiment will be described. The ink is supplied onto the ejection heaters 102 from a rear surface of the liquid ejection head substrate 101 via the supply orifices 103. Then, selected ejection heaters 102 are then heated by the heater drive circuits 104. Accordingly, air bubbles are generated in the ink on the ejection heaters 102, and the ink is subsequently ejected from the ejection orifices.

A signal supply circuit configured to supply an electric signal to the heater drive circuits 104 is arranged in the region B and the region C of the liquid ejection head substrate 101. The signal supply circuit according to the present exemplary embodiment includes at least a signal processing circuit 106 and a voltage generation circuit 107. The signal processing circuit 106 is arranged in the region B. The voltage generation circuit 107 is arranged in the region C.

The signal processing circuit 106 processes image information and control information transmitted from a main body (not illustrated) of the recording apparatus and supplies a control signal to the heater drive circuits 104. The control signal is supplied via signal lines that connect the signal processing circuit 106 to the heater drive circuits 104. The heater drive circuits 104 selectively drive the plurality of ejection heaters 102 on the basis of the control signal. The signal processing circuit 106 is constituted by a shift register circuit, a latch circuit, a logic gate, or the like.

The voltage generation circuit 107 shifts the level of a power supply voltage input from the outside and generates a power supply voltage to be supplied to the heater drive circuits 104. The power supply voltage is supplied via power supply lines that connect the voltage generation circuit 107 to the heater drive circuits 104. The power supply voltage input from the outside may be directly supplied to the heater drive circuits 104 without arranging the voltage generation circuit 107.

A plurality of pad electrodes 109 for establishing connection to the main body of the recording apparatus are also arranged in the region B and the region C of the liquid ejection head substrate 101. For example, power supply voltages for supplying electric energy to the ejection heaters 102, power supply voltages for driving the respective circuits, image information, control information, and the like are input via the pad electrodes 109. A power supply voltage for a sub heater which will be described below is also input via the pad electrodes 109.

The sub heater (first to third portions 111 to 113 of FIG. 1) which is configured to heat up the liquid ejection head substrate 101 is arranged on the liquid ejection head substrate 101 according to the present exemplary embodiment. The sub heater includes the first portion 111, the second portion 112, and the third portion 113. The sub heater is constituted by a conductive member such as gold, copper, aluminum, or polysilicon. The conductive member included in the sub heater is electrically isolated from power supply lines for supplying the electric energy to the ejection heaters 102. The conductive member included in the sub heater is electrically isolated from a power supply line and a signal line which are connected to the heater drive circuit 104. The conductive member included in the sub heater is electrically isolated from a power supply line and a signal line which are connected to the signal supply circuit.

The power supply lines and the signal lines which are connected to the heater drive circuits 104 are arranged on a first line layer. The power supply line and the signal line which are connected to the signal supply circuit are arranged on the first line layer. The power supply lines for supplying electric energy to the ejection heaters 102 are arranged on a second line layer. The conductive member constituting the sub heater is the first line layer or the second line layer. For example, the sub heater may be constituted only by the conductive member included in either the first line layer or the second line layer. Alternatively, the sub heater may include a conductive member in the first line layer and a conductive member in the second line layer. In a case where the sub heater includes the conductive members in a plurality of line layers, the conductive member in the first line layer is connected to the conductive member in the second line layer via a plug provided to an interlayer insulating film.

The first portion 111 of the sub heater is arranged in an area surrounding the region A of the liquid ejection head substrate 101, that is, the region where the ejection heaters 102 and the heater drive circuits 104 are arranged. Accordingly, a temperature in the region A can be increased.

The second portion 112 of the sub heater is arranged in an area surrounding the region B of the liquid ejection head substrate 101, that is, the region where the signal processing circuit 106 is arranged. Accordingly, a temperature in the region B can be increased.

The third portion 113 of the sub heater is arranged in an area surrounding the region C of the liquid ejection head substrate 101, that is, the region where the voltage generation circuit 107 is arranged. Accordingly, a substrate temperature in the region C can be increased, and it is possible to improve an ejection characteristic in a low temperature state.

As illustrated in FIG. 1, according to the present exemplary embodiment, the two pad electrodes 109 are connected to each other via the first portion 111, the second portion 112, and the third portion 113 of the sub heater. These pad electrodes 109 are connected to the liquid ejection head and the recording apparatus. For example, the power supply voltage is input to one of the pad electrodes 109, and the other pad electrode 109 is grounded. The voltage input to the pad electrode 109 is not limited to the above-described example. Two different voltages may be input to the two pad electrodes 109 connected to the sub heater. With the above-described configuration, the first portion 111, the second portion 112, and the third portion 113 of the sub heater form a common current path.

A resistance value per unit length of the second portion 112 of the sub heater is different from a resistance value per unit length of the first portion 111 of the sub heater and a resistance value per unit length of the third portion 113 of the sub heater. The term unit length mentioned herein is a length along a direction of a current flowing through the sub heater. A resistance value R of the sub heater is determined by a resistivity r of the conductive member constituting the sub heater, a thickness T of the conductive member, a line width W of the conductive member, and a line length L of the conductive member. Specifically, an expression $R=(r\times L)/(W\times T)$ is established. The line width W is a dimension in a direction orthogonal to the direction of the current of the conductive member constituting the sub heater. The line length L is a dimension in a direction along the direction of the current of the conductive member constituting the sub heater. In a case where a sheet resistance Rs of the conductive member constituting the sub heater is found, an expression $R=Rs\times W/L$ is established. A resistance value per unit length of the sub heater can be obtained by dividing the resistance value R by the line length L.

According to the present exemplary embodiment, the resistance value per unit length of the second portion 112 of the sub heater is lower than the resistance value per unit length of the first portion 111 of the sub heater and the resistance value per unit length of the third portion 113 of the sub heater. Specifically, according to the present exemplary embodiment, the first portion 111, the second portion 112, and the third portion 113 of the sub heater are composed of the same material. That is, the resistivity r of the conductive members constituting the sub heater is constant. Thicknesses of the conductive members constituting the first portion 111, the second portion 112, and the third portion 113 are substantially the same. The line width of the second portion 112 of the sub heater is larger than the line width of the first portion 111 and the line width of the third portion 113. In this manner, according to the present exemplary embodiment, the resistance values per unit length are made to vary via a difference in the line width.

The signal processing circuit 106 arranged in the region B processes the image information and the control information transmitted from the main body of the recording apparatus. When the amount of information processed by the signal processing circuit 106 is increased, the power consumption of the signal processing circuit 106 is increased, and in accordance with this increase, the heat generation quantity of the signal processing circuit 106 is increased. In particular, an influence from the heat generated by the signal processing circuit 106 greatly affects the ejection heaters 102 arranged close to the region B.

On the other hand, an influence from the heat generated by the voltage generation circuit 107 arranged in the region C affects the ejection heaters 102 arranged close to the region C. The heat generation quantity of the voltage generation circuit 107 is different from the heat generation quantity of the signal processing circuit 106. For that reason, the substrate temperature may vary in a portion close to the region B and a portion close to the region C out of the region A. It is noted that the heat generation quantity of the voltage generation circuit 107 is lower than the heat generation quantity of the signal processing circuit 106 in many cases.

According to the present exemplary embodiment, the resistance value per unit length of the second portion 112 of the sub heater is lower than the resistance value per unit length of the third portion 113 of the sub heater. For that reason, for example, in a case where a size of the current flowing through the second portion 112 is equal to a size of the current flowing through the third portion 113, a voltage drop in the second portion 112 can be set to be smaller than a voltage drop in the third portion 113. The heat generation quantity is generally proportional to a product of a current and a voltage. That is, according to the configuration of the present exemplary embodiment, the heat generation quantity per unit area of the second portion 112 of the sub heater can be set to be lower than the heat generation quantity per unit area of the third portion 113 of the sub heater. As a result, the temperature distribution of the liquid ejection head substrate 101 can be reduced. For example, a temperature difference between the region A and the region B in a case where the liquid ejection head substrate is operated by applying a current to the sub heater can be set to be smaller than a temperature difference between the region B and the region C in a case where the liquid ejection head substrate is operated without any energization of the sub heater. Alternatively, the temperature difference between the region B and the region C can be set to fall within a predetermined range by the sub heater. For example, this temperature difference can be set to be smaller than or equal to 50° C.

A sum of the heat generation quantity of the signal processing circuit 106 and the heat generation quantity of the second portion 112 of the sub heater is more preferably equal to a sum of the heat generation quantity of the voltage generation circuit 107 and the heat generation quantity of the third portion 113 of the sub heater.

The heat generation quantity of the region A where the ejection heaters 102 and the heater drive circuits 104 are arranged may be smaller than the heat generation quantity of the signal processing circuit 106 in some cases. According to the present exemplary embodiment, the resistance value per unit length of the second portion 112 of the sub heater is lower than the resistance value per unit length of the first portion 111 of the sub heater. According to the above-described configuration, the heat generation quantity per unit area of the second portion 112 of the sub heater can be set to be smaller than the heat generation quantity per unit area of the first portion 111 of the sub heater. As a result, the temperature distribution of the liquid ejection head substrate 101 can be reduced.

According to the present exemplary embodiment, a case has been described in which the heat generation quantity of the signal processing circuit 106 is larger than the heat generation quantity of the heater drive circuits 104 and the heat generation quantity of the voltage generation circuit 107. However, the present invention is not limited to the above-described example, and the line widths of the respective portions of the sub heater may be adjusted in accordance with a difference in the heat generation quantities in the respective regions of the liquid ejection head substrate. A circuit block included in the signal supply circuit is not limited to the signal processing circuit 106 or the voltage generation circuit 107. The signal supply circuit may include a circuit block such as an analog-to-digital (AD) converter circuit, a memory circuit, a timing generator circuit, or a protective circuit.

The line width of the second portion 112 may be the same as the line width of the third portion 113 and also, only the line width of the first portion 111 may be different from the line width of the second portion 112 and the line width of the third portion 113. According to the above-described configuration, the heat generation quantity of the region A where the ejection heaters 102 are arranged is different from the heat generation quantities of the region B and the region C where the signal supply circuit is arranged, the temperature distribution of the liquid ejection head substrate 101 can be set to be small.

Second Exemplary Embodiment

Another exemplary embodiment will be described. According to the present exemplary embodiment, a structure of the sub heater is different from that of the first exemplary embodiment. In view of this, only a different aspect from the first exemplary embodiment will be described, and a description of a part similar to the first exemplary embodiment will be omitted.

Figure 2:
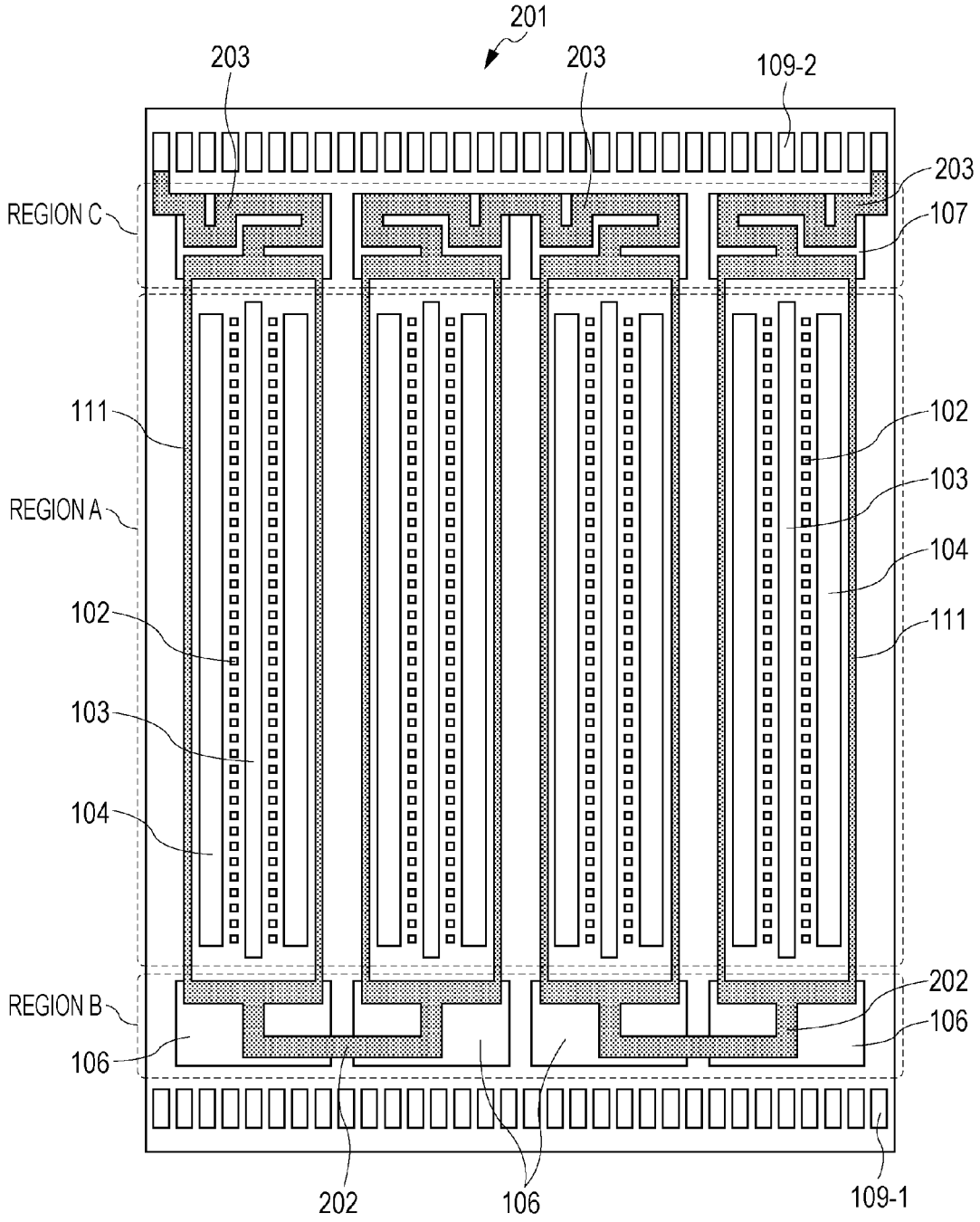
FIG. 2 schematically illustrates a planar structure of another liquid ejection head substrate.

FIG. 2 schematically illustrates a planar structure of a liquid ejection head substrate 201. A part having the same function as the first exemplary embodiment is assigned with the same reference symbol, and a detailed description thereof will be omitted.

The sub heater according to the present exemplary embodiment includes the first portion 111, a second portion 202, and a third portion 203. The first portion 111 of the sub heater is arranged in an area surrounding the region A of the liquid ejection head substrate 201, that is, the region where the ejection heaters 102 and the heater drive circuits 104 are arranged. The second portion 202 of the sub heater is arranged in an area surrounding the region B of the liquid ejection head substrate 201, that is, the region where the signal processing circuit 106 is arranged. The third portion 203 of the sub heater is arranged in an area surrounding the region C of the liquid ejection head substrate 201, that is, the region where the voltage generation circuit 107 is arranged.

A line length of the second portion 202 of the sub heater is different from a line length of the third portion 203 of the sub heater. According to the present exemplary embodiment, the line length of the second portion 202 of the sub heater is shorter than the line length of the third portion 203 of the sub heater. The line length is a total sum of lengths along the direction of the flowing current of the conductive members constituting the sub heater.

An area density of the second portion 202 of the sub heater is different from an area density of the third portion 203 of the sub heater. According to the present exemplary embodiment, the area density of the second portion 202 of the sub heater is lower than the area density of the third portion 203 of the sub heater. An area density of the sub heater can be obtained by dividing the area of a region where the conductive members constituting the sub heater are arranged by the area of a predetermined region of the liquid ejection head substrate. For example, the area density of the second portion 202 of the sub heater can be obtained by dividing the area of the region where the conductive members constituting the second portion 202 are arranged by the area of the region B.

According to the present exemplary embodiment, the second portion 202 and the third portion 203 of the sub heater are composed of a same material. Furthermore, a thickness and a line width of the second portion 202 are respectively the same as a thickness and a line width of the third portion 203. Therefore, a resistance value per unit length of the second portion 202 of the sub heater is the same as a resistance value per unit length of the third portion 203 of the sub heater.

According to the above-described configuration, the resistance value of the entire second portion 202 of the sub heater can be set to be lower than the resistance value of the entire third portion 203 of the sub heater. For that reason, for example, in a case where a size of a current flowing through the second portion 202 is equal to a size of a current flowing through the third portion 203, a voltage drop in the second portion 202 can be set to be smaller than a voltage drop in the third portion 203. The heat generation quantity is generally proportional to a product of a current and a voltage. That is, according to the configuration of the present exemplary embodiment, the heat generation quantity per unit area by the second portion 202 of the sub heater can be set to be lower than the heat generation quantity per unit area by the third portion 203 of the sub heater. As a result, it is possible to reduce the temperature distribution of the liquid ejection head substrate 201. For example, a temperature difference between the region A and the region B in a case where the liquid ejection head substrate is operated by applying a current to the sub heater can be set to be smaller than a temperature difference between the region B and the region C in a case where the liquid ejection head substrate is operated without any energization of the sub heater. Alternatively, the temperature difference between the region B and the region C can be set to fall within a predetermined range by the sub heater. For example, this temperature difference can be set to be smaller than or equal to 50° C.

The configuration illustrated in FIG. 2 is an example in which the heat generation quantity of the signal processing circuit 106 is higher than the heat generation quantity of the voltage generation circuit 107. However, the configuration is not limited to the above-described example, and the line lengths and the area densities of the respective portions of the sub heater may be adjusted in accordance with a difference in the heat generation quantities in the respective regions of the liquid ejection head substrate. For example, in a case where the heat generation quantity of the voltage generation circuit 107 is higher than the heat generation quantity of the signal processing circuit 106, the line length of the second portion 202 is longer than the line length of the third portion 203. In addition, the circuit block included in the signal supply circuit is not limited to the signal processing circuit 106 or the voltage generation circuit 107. The signal supply circuit may include a circuit block such as an AD converter circuit, a memory circuit, a timing generator circuit, or a protection circuit.

Moreover, as in the first exemplary embodiment, the line width of the second portion 202 may be different from the line width of the third portion 203. In this manner, when both the line length and the line width are varied, it is possible to further reduce the temperature distribution of the liquid ejection head substrate 101.

The second portion 202 and the third portion 203 of the sub heater according to the present exemplary embodiment are respectively similar to the second portion and the third portion of the sub heater according to the first exemplary embodiment except for the different relative relationships of the line lengths.

Third Exemplary Embodiment

Another exemplary embodiment will be described. According to the present exemplary embodiment, a structure of the sub heater is different from that of the first exemplary embodiment. In view of this, only a different aspect from the first exemplary embodiment will be described, and a description of a part similar to the first exemplary embodiment will be omitted.

Figure 3:
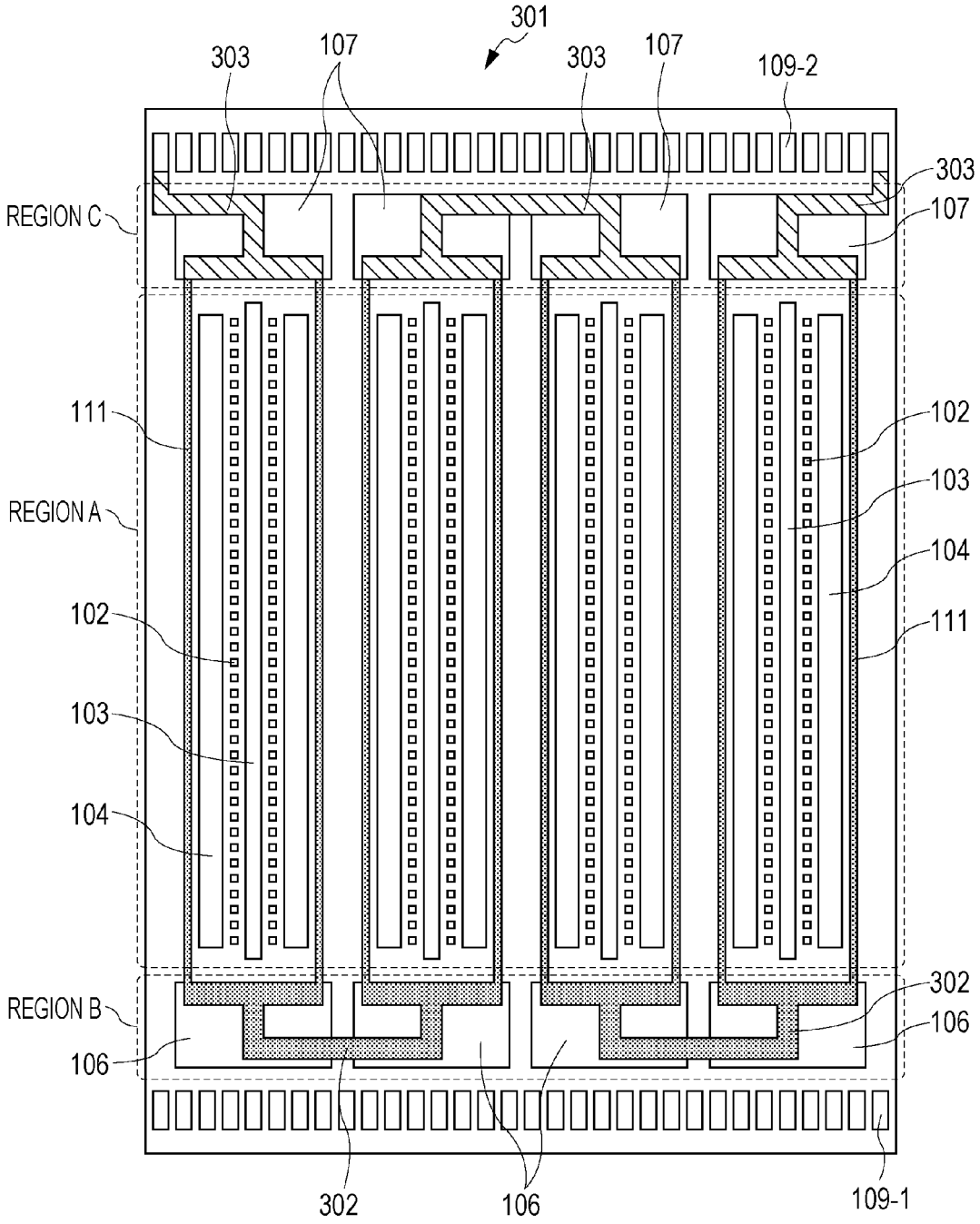
FIG. 3 schematically illustrates a planar structure of another liquid ejection head substrate.

FIG. 3 schematically illustrates a planar structure of a liquid ejection head substrate 301. A part having the same function as the first exemplary embodiment is assigned with the same reference symbol, and a detailed description thereof will be omitted.

The sub heater according to the present exemplary embodiment includes the first portion 111, a second portion 302, and a third portion 303. The first portion 111 of the sub heater is arranged in an area surrounding the region A of the liquid ejection head substrate 301, that is, the region where the ejection heaters 102 and the heater drive circuits 104 are arranged. The second portion 302 of the sub heater is arranged in an area surrounding the region B of the liquid ejection head substrate 301, that is, the region where the signal processing circuit 106 is arranged. The third portion 303 of the sub heater is arranged in an area surrounding the region C of the liquid ejection head substrate 301, that is, the region where the voltage generation circuit 107 is arranged.

A resistance value per unit length of the second portion 302 of the sub heater is different from a resistance value per unit length of the third portion 303 of the sub heater. According to the present exemplary embodiment, the resistance value per unit length of the second portion 302 of the sub heater is lower than the resistance value per unit length of the third portion 303 of the sub heater. Specifically, a thickness and a line width of the second portion 302 are respectively the same as a thickness and a line width of the third portion 303. The sheet resistance of the second portion 302 of the sub heater is lower than the sheet resistance of the third portion 303 of the sub heater. In this manner, according to the present exemplary embodiment, the resistance value per unit length may be varied depending on the difference in the sheet resistance.

As a method of varying the sheet resistance, materials having mutually different resistivities may be used for the second portion 302 and the third portion 303 of the sub heater. For example, a metal such as gold, copper, or aluminum is used for the second portion 302, and on the other hand, polysilicon or the like is used for the third portion 303. In general, a resistivity of a metal is lower than a resistivity of polysilicon. Alternatively, as another method of varying the sheet resistance, a thickness of the second portion 302 of the sub heater may be varied from a thickness of the third portion 303. As the thickness is increased, the sheet resistance is decreased.

According to the above-described configuration, the resistance value of the entire second portion 302 of the sub heater can be set to be lower than the resistance value of the entire third portion 303 of the sub heater. For that reason, for example, in a case where currents having a same size flow through the second portion 302 and the third portion 303, the voltage drop in the second portion 302 can be set to be smaller than the voltage drop in the third portion 303. The heat generation quantity is generally proportional to a product of a current and a voltage. That is, according to the configuration of the present exemplary embodiment, the heat generation quantity per unit area by the second portion 302 of the sub heater can be set to be lower than the heat generation quantity per unit area by the third portion 303 of the sub heater. As a result, it is possible to reduce the temperature distribution of the liquid ejection head substrate 301.

For example, a temperature difference between the region A and the region B in a case where the liquid ejection head substrate is operated by applying a current to the sub heater can be set to be smaller than a temperature difference between the region B and the region C in a case where the liquid ejection head substrate is operated without any energization of the sub heater. Alternatively, the temperature difference between the region B and the region C can be set to fall within a predetermined range by the sub heater. For example, this temperature difference can be set to be smaller than or equal to 50° C.

The configuration illustrated in FIG. 3 is an example in which the heat generation quantity of the signal processing circuit 106 is higher than the heat generation quantity of the voltage generation circuit 107. However, the configuration is not limited to the above-described example, and sheet resistances of the respective portions of the sub heater may be adjusted in accordance with a difference in the heat generation quantities in the respective regions of the liquid ejection head substrate. In addition, the circuit block included in the signal supply circuit is not limited to the signal processing circuit 106 or the voltage generation circuit 107. The signal supply circuit may include a circuit block such as an AD converter circuit, a memory circuit, a timing generator circuit, or a protection circuit.

As a modified example, the sheet resistance may be varied in the first portion 111 and the second portion 302 or between the first portion 111 and the third portion 303. In this case, the sheet resistance of the second portion 302 may be equal to the sheet resistance of the third portion 303.

Moreover, as in the first exemplary embodiment, the line width of the second portion 302 may be different from the line width of the third portion 303. Alternatively, as in the second exemplary embodiment, the line length of the second portion 302 may be different from the line length of the third portion 303. In this manner, when the sheet resistance and one or both of the line length and the line width are varied in the second portion 302 and the third portion 303, it is possible to further reduce the temperature distribution of the liquid ejection head substrate 101.

The second portion 302 of the sub heater and the third portion 303 according to the present exemplary embodiment are respectively similar to the second portion and the third portion of the sub heater according to the first exemplary embodiment or the second exemplary embodiment except for the different relative relationships of the sheet resistances.

Fourth Exemplary Embodiment

Another exemplary embodiment will be described. According to the present exemplary embodiment, a configuration of the sub heater is different from that of the first exemplary embodiment. In view of this, only a different aspect from the first exemplary embodiment will be described, and a description of a part similar to the first exemplary embodiment will be omitted.

Figure 4:
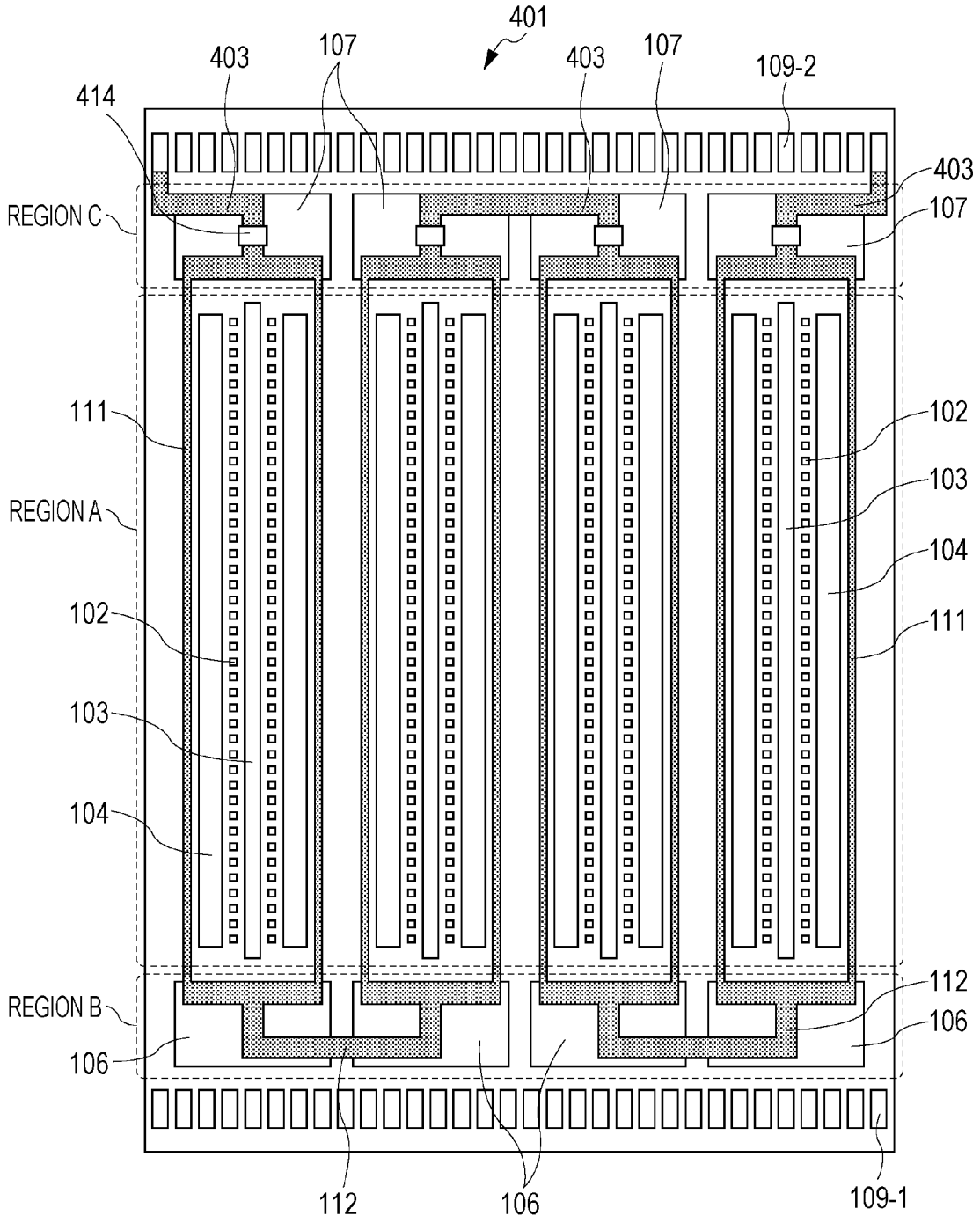
FIG. 4 schematically illustrates a planar structure of another liquid ejection head substrate.

FIG. 4 schematically illustrates a planar structure of a liquid ejection head substrate 401. A part having the same function as the first exemplary embodiment is assigned with the same reference symbol, and a detailed description thereof will be omitted.

The sub heater according to the present exemplary embodiment includes the first portion 111, the second portion 112, and a third portion 403. The first portion 111 of the sub heater is arranged in an area surrounding the region A of the liquid ejection head substrate 401, that is, the region where the ejection heaters 102 and the heater drive circuits 104 are arranged. The second portion 112 of the sub heater is arranged in an area surrounding the region B of the liquid ejection head substrate 401, that is, the region where the signal processing circuit 106 is arranged. The third portion 403 of the sub heater is arranged in an area surrounding the region C of the liquid ejection head substrate 301, that is, the region where the voltage generation circuit 107 is arranged.

According to the present exemplary embodiment, the third portion 403 of the sub heater includes a resistor 414. A resistance value per unit length of the resistor 414 is different from the resistance value per unit length of the first portion 111 of the sub heater and the resistance value per unit length of the third portion 113 of the sub heater. According to the present exemplary embodiment, the resistance value per unit length of the resistor 414 is higher than the resistance value per unit length of the first portion 111 of the sub heater and the resistance value per unit length of the third portion 113 of the sub heater. The resistor 414 is constituted, for example, by an impurity-doped semiconductor region.

According to the above-described configuration, the resistance value of the entire second portion 112 of the sub heater can be set to be lower than the resistance value of the entire third portion 403 of the sub heater. For that reason, for example, in a case where currents having a same size flow through the second portion 112 and the third portion 403, the voltage drop in the second portion 112 can be set to be smaller than the third portion 403. The heat generation quantity is generally proportional to a product of a current and a voltage. That is, according to the configuration of the present exemplary embodiment, the heat generation quantity per unit area of the second portion 112 of the sub heater can be set to be lower than the heat generation quantity per unit area of the third portion 403 of the sub heater. As a result, it is possible to reduce the temperature distribution of the liquid ejection head substrate 401. For example, a temperature difference between the region A and the region B in a case where the liquid ejection head substrate is operated by applying a current to the sub heater can be set to be smaller than a temperature difference between the region B and the region C in a case where the liquid ejection head substrate is operated without any energization of the sub heater. Alternatively, the temperature difference between the region B and the region C can be set to fall within a predetermined range by the sub heater. For example, this temperature difference can be set to be smaller than or equal to 50° C.

The configuration illustrated in FIG. 4 is an example in which the heat generation quantity of the signal processing circuit 106 is higher than the heat generation quantity of the voltage generation circuit 107. However, the configuration is not limited to the above-described example, and resistors may be provided in the respective portions of the sub heater in accordance with a difference in the heat generation quantities in the respective regions of the liquid ejection head substrate. In addition, the circuit block included in the signal supply circuit is not limited to the signal processing circuit 106 or the voltage generation circuit 107. The signal supply circuit may include a circuit block such as an AD converter circuit, a memory circuit, a timing generator circuit, or a protection circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-175726, filed Aug. 27, 2013, which is hereby incorporated by reference herein in its entirety.

What is claimed is:

1. A liquid ejection head substrate comprising:

a first pad electrode;

a second pad electrode which is different from the first pad electrode;

a first heater column provided in a region and comprising a plurality of ejection heaters arranged in a first direction;

a drive circuit configured to supply electric energy to the plurality of ejection heaters;

a signal supply circuit configured to supply an electric signal to the drive circuit and including:

a first circuit block arranged between the first pad electrode and the region; and a second circuit block arranged between the second pad electrode and the region; and a substrate heating heater including:

a first portion arranged between the first pad electrode and the region; and a second portion arranged between the second pad electrode and the region, wherein a resistance value per unit length along a direction of a current of a part of the first portion is different from a resistance value per unit length along a direction of a current of a part of the second portion, wherein the part of the first portion extends in a second direction which intersects the first direction, and wherein the part of the second portion extends in a third direction which intersects the first direction.

2. The liquid ejection head substrate according to claim 1, wherein a line width of the first portion is different from a line width of the second portion.

3. The liquid ejection head substrate according to claim 1, wherein the first portion and the second portion constitute a common current path.

4. The liquid ejection head substrate according to claim 1:

wherein the first pad electrode and the second pad electrode are configured to apply a current to the substrate heating heater, and wherein the first pad electrode and the second pad electrode are connected to each other via the first portion and the second portion.

5. The liquid ejection head substrate according to claim 1, wherein the electric signal supplied by the signal supply circuit is any one of a control signal of the drive circuit based on information supplied from the outside and a power supply voltage of the drive circuit.

6. The liquid ejection head substrate according to claim 1, wherein the first circuit block is a signal processing circuit configured to supply a control signal to the drive circuit on the basis of information supplied from the outside, and wherein the second circuit block is a voltage generation circuit configured to supply a power supply voltage of the drive circuit.

7. The liquid ejection head substrate according to claim 1, wherein the resistance value per unit length along the direction of the current of the first portion is different from the resistance value per unit length along the direction of the current of the second portion such that a difference between a temperature of the first portion and a temperature of the second portion becomes smaller than the difference in a case where the ejection heaters are operated without energization of the substrate heating heater.

8. The liquid ejection head substrate according to claim 1, wherein a line width of the first portion is different from a line width of the second portion.

9. The liquid ejection head substrate according to claim 1, wherein the first pad electrode is arranged on a first side of the liquid ejection head substrate and the second pad electrode is arranged on a second side which is opposite side to the first side.

10. The liquid ejection head substrate according to claim 1, wherein the first circuit block comprises a voltage generation circuit and the second circuit block comprises a signal processing circuit.

11. The liquid ejection head substrate according to claim 1, wherein a heat generation quantity of the first circuit block is different from a heat generation quantity of the second circuit block.

12. The liquid ejection head substrate according to claim 1, further comprising a second heater column provided in the region and comprising a plurality of ejection heaters arranged in the first direction, wherein the first heater column and the second heater column are arranged in the second direction.

13. The liquid ejection head substrate according to claim 12, further comprising an another driver circuit configured to supply electric energy to the plurality of ejection heaters in the second ejection heater, wherein, in the first heater column, the plurality of ejection heaters are arranged in the first direction without the drive circuit interposed therebetween, and wherein, in the second heater column, the plurality of ejection heaters are arranged in the first direction without the another drive circuit interposed therebetween.

14. The liquid ejection head substrate according to claim 12, wherein a distance between two of the plurality of ejection heaters in the first column is longer than a distance between one of the plurality of ejection heaters in the first heater and one of the plurality of ejection heaters in the second heater, and wherein the two of the plurality of ejection heaters are adjacent to each other in the first column.

15. A liquid ejection head comprising:

a liquid ejection head substrate comprising:

a first pad electrode;

a second pad electrode which is different from the first pad electrode;

a first heater column provided in a region and comprising a plurality of ejection heaters arranged in a first direction;

a drive circuit configured to supply electric energy to the plurality of ejection heaters;

a signal supply circuit configured to supply an electric signal to the drive circuit and including:

a first circuit block arranged between the first pad electrode and the region; and a second circuit block arranged between the second pad electrode and the region; and a substrate heating heater including;

a first portion arranged between the first pad and the region; and a second portion arranged between the second pad electrode and the region; and an ink supply unit configured to supply recording ink to the liquid ejection head substrate, wherein a resistance value per unit length along a direction of a current of a part of the first portion is different from a resistance value per unit length along a direction of a current of a part of the second portion, wherein the part of the first portion extends in a second direction which intersects the first direction, and wherein the part of the second portion extends in a third direction which intersects the first direction.

16. The liquid ejection head according to claim 15, wherein a line width of the first portion is different from a line width of the second portion.

17. The liquid ejection head according to claim 15, wherein the first pad electrode is arranged on a first side of the liquid ejection head substrate and the second pad electrode is arranged on a second side which is opposite side to the first side.

18. The liquid ejection head according to claim 15, wherein the first circuit block comprises a voltage generation circuit and the second circuit block comprises a signal processing circuit.

19. The liquid ejection head according to claim 15, wherein a heat generation quantity of the first circuit block is different from a heat generation quantity of the second circuit block.

20. The liquid ejection head according to claim 15, further comprising a second heater column provided in the region and comprising a plurality of ejection heaters arranged in the first direction, wherein the first heater column and the second heater column are arranged in the second direction.

21. The liquid ejection head according to claim 20, further comprising an another driver circuit configured to supply electric energy to the plurality of ejection heaters in the second ejection heater, wherein, in the first heater column, the plurality of ejection heaters are arranged in the first direction without the drive circuit interposed therebetween, and wherein, in the second heater column, the plurality of ejection heaters are arranged in the first direction without the another drive circuit interposed therebetween.

22. The liquid ejection head according to claim 20, wherein a distance between two of the plurality of ejection heaters in the first column is longer than a distance between one of the plurality of ejection heaters in the first heater and one of the plurality of ejection heaters in the second heater, and wherein the two of the plurality of ejection heaters are adjacent to each other in the first column.

23. A recording apparatus comprising:

a liquid ejection head comprising:

a liquid ejection head substrate comprising:

a first pad electrode;

a second pad electrode which is different from the first pad electrode:

a first heater column provided in a region and comprising a plurality of ejection heaters arranged in a first direction;

a drive circuit configured to supply electric energy to the plurality of ejection heaters;

a signal supply circuit configured to supply an electric signal to the drive circuit and including:

a first circuit block arranged between the first pad electrode and the region; and a second circuit block arranged between the second pad electrode and the region; and a substrate heating heater including:

a first portion arranged between the first pad electrode and the region; and a second portion arranged between the second pad electrode and the region; and an ink supply unit configured to supply recording ink to the liquid ejection head substrate; and a drive unit configured to drive the liquid ejection head, wherein a resistance value per unit length along a direction of a current of a part of the first portion is different from a resistance value per unit length along a direction of a current of a part of the second portion, wherein the part of the first portion extends in a second direction which intersects the first direction, and wherein the part of the second portion extends in a third direction which intersects the first direction.

24. The recording apparatus according to claim 23, wherein a line width of the first portion is different from a line width of the second portion.

25. The recording apparatus according to claim 23, wherein the first pad electrode is arranged on a first side of the liquid ejection head substrate and the second pad electrode is arranged on a second side which is opposite side to the first side.

26. The recording apparatus according to claim 23, wherein the first circuit block comprises a voltage generation circuit and the second circuit block comprises a signal processing circuit.

27. The recording apparatus according to claim 23, wherein a heat generation quantity of the first circuit block is different from a heat generation quantity of the second circuit block.

28. The recording apparatus according to claim 23, further comprising a second heater column provided in the region and comprising a plurality of ejection heaters arranged in the first direction, wherein the first heater column and the second heater column are arranged in the second direction.

29. The recording apparatus according to claim 28, further comprising an another driver circuit configured to supply electric energy to the plurality of ejection heaters in the second ejection heater, wherein, in the first heater column, the plurality of ejection heaters are arranged in the first direction without the drive circuit interposed therebetween, and wherein, in the second heater column, the plurality of ejection heaters are arranged in the first direction without the another drive circuit interposed therebetween.

30. The recording apparatus according to claim 28, wherein a distance between two of the plurality of ejection heaters in the first column is longer than a distance between one of the plurality of ejection heaters in the first heater and one of the plurality of ejection heaters in the second heater, and wherein the two of the plurality of ejection heaters are adjacent to each other in the first column.

* * * * *